US010022885B2

(12) United States Patent
Isogai

(10) Patent No.: US 10,022,885 B2
(45) Date of Patent: Jul. 17, 2018

(54) PUNCHING DEVICE, IMAGE FORMING APPARATUS, AND PUNCHING METHOD

(71) Applicant: KYOCERA Document Solutions Inc., Osaka-shi, Osaka (JP)

(72) Inventor: Yoji Isogai, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 527 days.

(21) Appl. No.: 14/676,830

(22) Filed: Apr. 2, 2015

(65) Prior Publication Data

US 2015/0283722 A1 Oct. 8, 2015

(30) Foreign Application Priority Data

Apr. 4, 2014 (JP) ..... 2014-078000

(51) Int. Cl.
*B26F 1/02* (2006.01)
*B26D 5/32* (2006.01)
(Continued)

(52) U.S. Cl.
CPC ..... *B26F 1/02* (2013.01); *B26D 5/32* (2013.01); *B26D 5/34* (2013.01); *B26F 1/0092* (2013.01);
(Continued)

(58) Field of Classification Search
CPC ... Y10T 83/148; Y10T 83/152; Y10T 83/169; Y10T 83/175; Y10T 83/178;
(Continued)

(56) References Cited

U.S. PATENT DOCUMENTS 5,839,336 A * 11/1998 Yamauchi ..... B26D 1/06 355/408
5,911,414 A 6/1999 Kato et al.
2007/0062351 A1* 3/2007 Iguchi ..... B26D 5/00 83/13

FOREIGN PATENT DOCUMENTS

JP H10194557 A 7/1998
JP 2004009245 A 1/2004
(Continued)

OTHER PUBLICATIONS

Office Action issued in the counterpart Japanese Patent Application No. JP2014-078000, dated Jul. 19, 2016.

*Primary Examiner* — Laura M Lee
(74) *Attorney, Agent, or Firm* — Viering, Jentschura & Partner mbB

(57) ABSTRACT

A punching device includes a punching unit, a driving unit, an edge detecting unit, a punching position setting unit, and a punching controlling unit. The punching unit punches three holes in a transported sheet along its transport direction. The driving unit moves the punching unit in an orthogonal direction. The edge detecting unit detects, in at least two locations separated from each other in the transport direction, an edge position of an edge of the sheet on one side in the orthogonal direction. The punching position setting unit sets a punching position corresponding to a hole to be punched by the punching unit in the orthogonal direction, on the basis of an amount of change in the orthogonal direction between the two edge positions. The punching controlling unit causes the punching unit to move to the punching position and punch a hole in the sheet.

3 Claims, 14 Drawing Sheets

(51) Int. Cl.
*B26D 5/34* (2006.01)
*B26F 1/00* (2006.01)

(52) U.S. Cl.
CPC ..... *Y10T 83/0481* (2015.04); *Y10T 83/145* (2015.04); *Y10T 83/538* (2015.04)

(58) Field of Classification Search
CPC ... Y10T 83/533; Y10T 83/538; Y10T 83/541; Y10T 83/543; Y10T 83/525; B26F 1/02; B26F 1/0092; B26D 5/32; B26D 5/34
USPC ..... 83/74, 75, 76.4, 76.7, 76.8, 370, 371, 83/365, 367, 368
See application file for complete search history.

(56) References Cited

FOREIGN PATENT DOCUMENTS

| | | | |
|---|---|---|---|
| JP | 2009161312 | A | 7/2009 |
| JP | 2013129470 | A | 7/2013 |

* cited by examiner

PUNCHING DEVICE, IMAGE FORMING APPARATUS, AND PUNCHING METHOD

INCORPORATION BY REFERENCE

The disclosure of Japanese Patent Application No. 2014-78000 filed on Apr. 4, 2014 including the specification, drawings and abstract is incorporated herein by reference in its entirety.

BACKGROUND

The present disclosure relates to a punching device which performs punching processing for forming punch holes in a sheet, an image forming apparatus including the punching device, and a punching method for forming punch holes.

A punching device is known which performs punching processing for forming punch holes in each sheet discharged from a main body of an image forming apparatus such as a printer, a copier, a facsimile machine, or a multifunctional peripheral having the functions of those apparatuses. In general, the punching device and other devices performing stapling, center folding, and other processing are unitized as a post-processing apparatus, which is connected to the main body of the image forming apparatus for use.

In this type of punching device, conventionally, the position for performing the punching operation has been fixed. Therefore, if the sheet transported to the punching device is inclined with respect to the sheet transport direction, the punching processing cannot be performed at an appropriate position of the sheet. As a result, the punched position will vary for each sheet, leading to degradation in appearance when the sheets on which the holes were formed are bound. Thus, a punching device has been proposed which is configured to be movable in the direction orthogonal to the sheet transport direction, for making it possible to adjust the position in the orthogonal direction at which the punching device will perform the punching processing.

Further, for punching a plurality of holes along the sheet transport direction, in order to correct the position in the orthogonal direction for the punching device to perform the punching processing in accordance with the inclined state of the sheet, there is a case where the position of an edge of the sheet in the orthogonal direction is detected and the position for the punching device to perform the punching processing is determined on the basis of the detected edge position.

SUMMARY

A punching device according to an aspect of the present disclosure includes a punching unit, a driving unit, an edge detecting unit, a punching position setting unit, and a punching controlling unit. The punching unit is capable of punching at least three holes in a transported sheet sequentially along a transport direction of the sheet. The driving unit moves the punching unit in an orthogonal direction which is orthogonal to the transport direction. The edge detecting unit detects, in at least two locations separated from each other in the transport direction, an edge position of an edge of the sheet on one side in the orthogonal direction. The punching position setting unit sets a punching position corresponding to a hole to be punched by the punching unit in the orthogonal direction, on the basis of an amount of change in the orthogonal direction between the at least two edge positions detected by the edge detecting unit. The punching controlling unit causes the punching unit to move to the punching position set by the punching position setting unit and punch a hole in the sheet.

An image forming apparatus according to another aspect of the present disclosure includes the punching device.

A punching method according to a further aspect of the present disclosure includes the following three steps. The first step is detecting, in at least two locations separated from each other in a transport direction of a transported sheet, an edge position of an edge of the sheet on one side in an orthogonal direction which is orthogonal to the transport direction. The second step is setting a punching position corresponding to a hole to be punched by a punching unit in the orthogonal direction, on the basis of an amount of change in the orthogonal direction between the at least two edge positions detected in the first step, the punching unit being capable of punching at least three holes in the transported sheet sequentially along the transport direction of the sheet. The third step is causing the punching unit to move to the punching position set in the second step and punch a hole in the sheet.

DETAILED DESCRIPTION

An embodiment of the present disclosure will be described below with reference to the drawings as appropriate. It should be noted that the embodiment described below is merely an example embodying the present disclosure; the embodiment of the present disclosure can be modified as appropriate without changing the gist of the present disclosure. First, the configuration of an image forming apparatus 1 (an example of the image forming apparatus of the present disclosure) according to an embodiment of the present disclosure will be described with reference to FIGS. 1 to 10.

Figure 1:
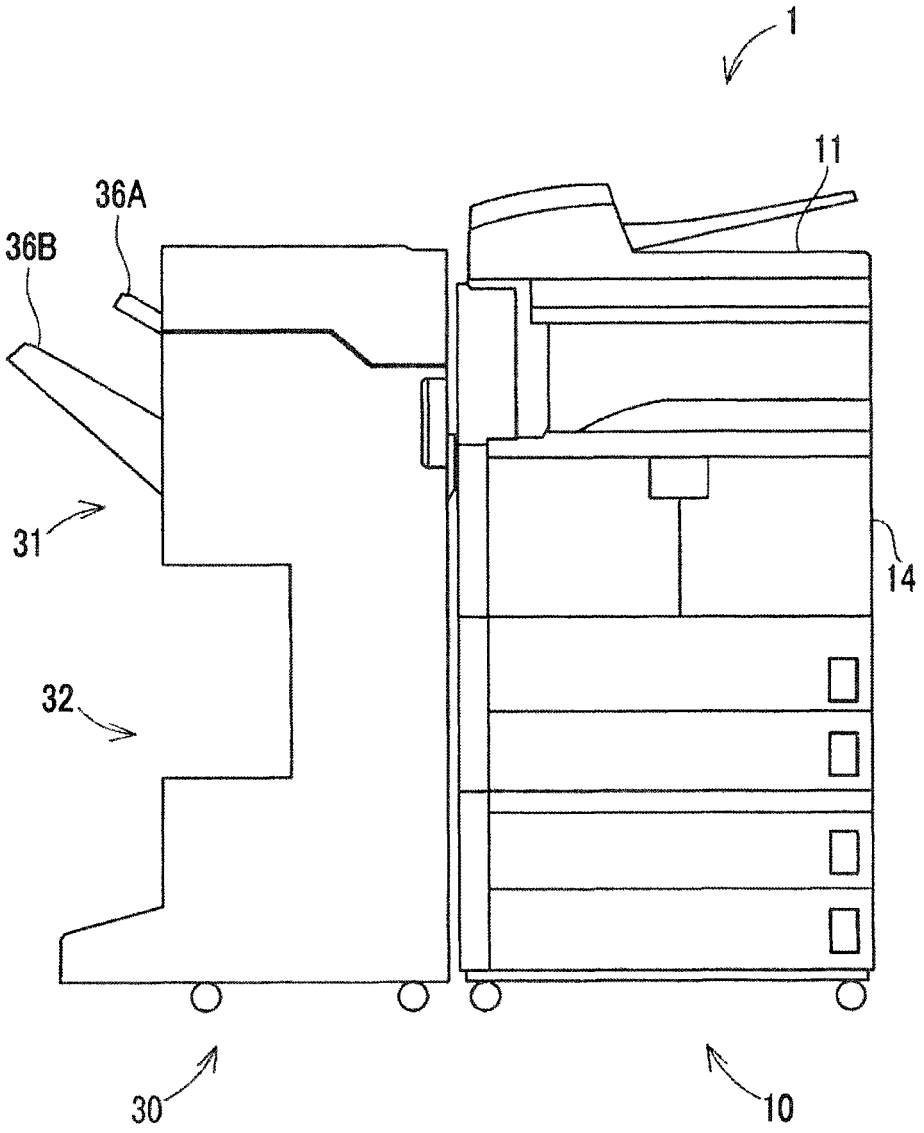
FIG. 1 shows the configuration of an image forming apparatus according to an embodiment of the present disclosure.

As shown in FIG. 1, the image forming apparatus 1 has an image forming apparatus main body 10 and a post-processing apparatus 30. The image forming apparatus main body 10 is a multifunctional peripheral which has the functions as a printer, a copier, and a facsimile machine. The image forming apparatus main body 10 prints an input image on a sheet S (an example of the sheet of the present disclosure) using a printing material such as toner. The image forming apparatus main body 10 is not limited to the multifunctional peripheral; the present disclosure is also applicable to a dedicated machine such as a printer, a facsimile machine, or a copier.

Figure 2:
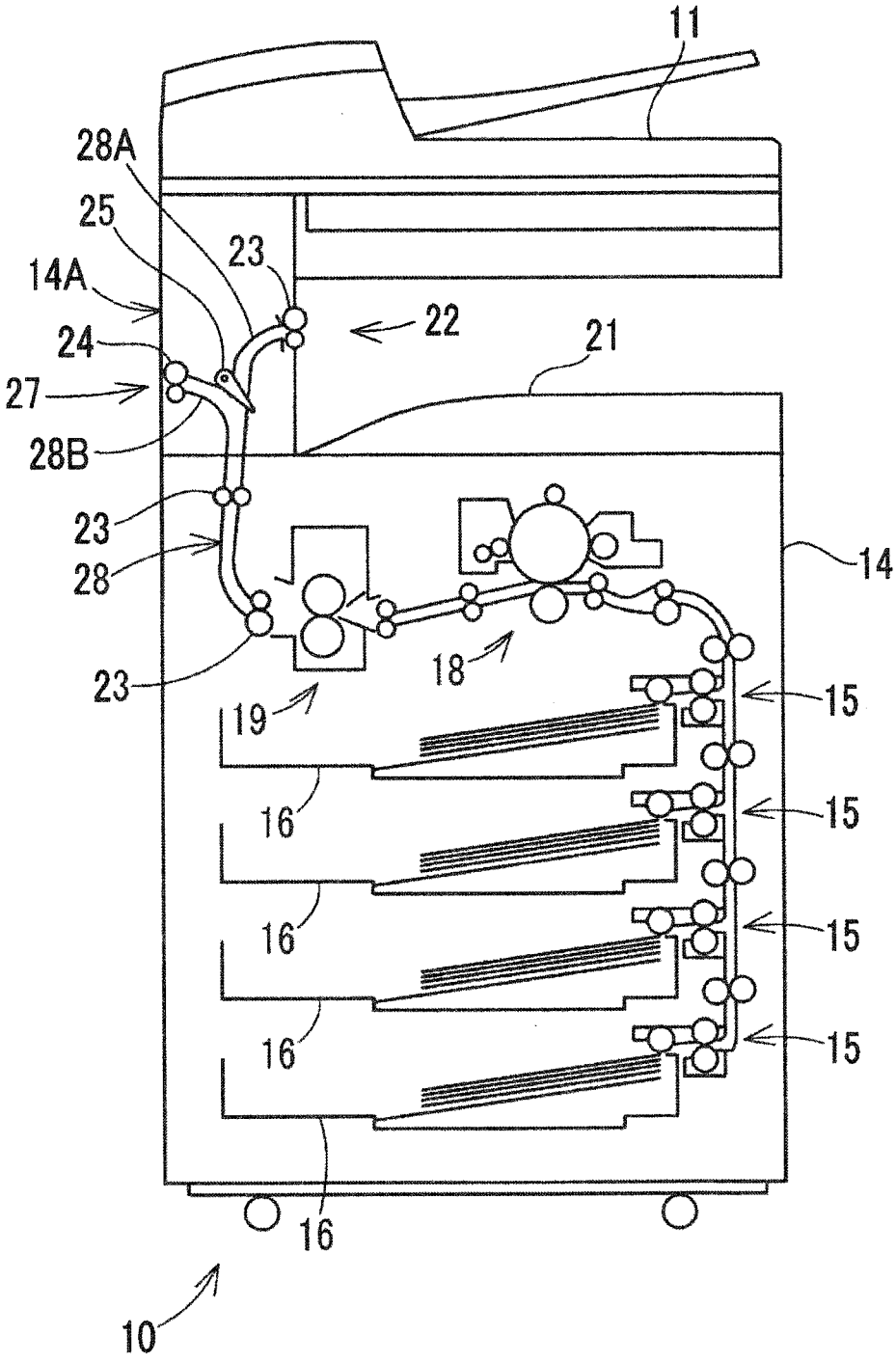
FIG. 2 is a cross-sectional view showing the configuration of an image forming apparatus main body of the image forming apparatus according to the embodiment of the present disclosure.

The image forming apparatus main body 10 prints an image on a sheet S on the basis of image data externally input via a network communication unit (not shown) or image data read by a scanner 11 disposed in an upper portion of the image forming apparatus main body 10. As shown in FIG. 2, the image forming apparatus main body 10 primarily includes an electrophotographic image forming unit 18, a fixing unit 19, a paper feeding unit 15, a paper discharge unit 21, a pair of paper discharge rollers 24, and a control unit 100 (see FIG. 5). These components are disposed inside a housing 14 constituting an outer frame cover and an inner frame of the image forming apparatus main body 10.

As shown in FIG. 2, four paper feeding units 15 are disposed in a lower portion of the image forming apparatus main body 10, and arranged in the up-and-down direction. Each paper feeding unit 15 feeds a sheet S, stored in a paper tray 16, to the image forming unit 18. As a sheet S is fed to the image forming unit 18 by the paper feeding unit 15, the image forming unit 18 transfers a toner image onto a surface of the sheet S, which is then transported to the fixing unit 19. The image forming unit 18 has a well-known mechanism with a laser scanning unit (LSU), a photoconductive drum, a developing device, a charging device, a transfer device, and so on, and therefore, a detailed description thereof will be omitted here.

The fixing unit 19 has a heating unit such as an induction heating (IH) unit. The fixing unit 19 applies heat to the toner image transferred on the sheet S, to fix the image on the sheet S. While the sheet S passes through the fixing unit 19, toner of the toner image melts with the heat applied from the fixing unit 19, so the toner image is fixed on the sheet S, whereby an image is formed on the sheet S. The sheet S with the image fixed thereon by the fixing unit 19 is fed onto a transport path 28 which is formed downstream of the fixing unit 19 in the transport direction of the sheet S. The sheet S fed onto the transport path 28 is further transported to the downstream side in the transport direction of the sheet S by a plurality of pairs of paper transport rollers 23 disposed along the transport path 28.

The transport path 28 curves upward from the fixing unit 19 and then extends straight up in the vertical direction. The transport path 28 branches into two paths on the downstream side in the transport direction of the sheet S. One branch 28A of the transport path 28 leads to a sheet discharge port 22, while the other branch 28B leads to a transport relay port 27 formed on a left-side surface 14A of the housing 14. At the branch point between the branches 28A and 28B, a flap 25 is provided which is pivotally moved by a driving unit (not shown) such as a motor or a solenoid.

When a sheet S is to be discharged to the paper discharge unit 21 disposed in the upper portion of the image forming apparatus main body 10, the flap 25 is pivotally moved to a paper discharge position in which the flap 25 can guide the sheet S onto the branch 28A by blocking the branch 28B. Therefore, when the flap 25 is in the paper discharge position, the sheet S fed onto the transport path 28 is discharged to the paper discharge unit 21 by the pairs of paper transport rollers 23. When a sheet S is to be transported to the post-processing apparatus 30, the flap 25 is pivotally moved to a relay position (the position shown in FIG. 2) in which the flap 25 can guide the sheet S onto the branch 28B by blocking the branch 28A. As shown in FIG. 2, the branch 28B is provided with the pair of paper discharge rollers 24 which transports the sheet S with an image formed thereon, to the post-processing apparatus 30. The pair of paper discharge rollers 24 is composed of a driving roller, which is rotatively driven by a motor or the like, and a driven roller, which is driven as it is in pressure contact with the driving roller. Therefore, when the flap 25 is in the relay position, the sheet S is transported to the post-processing apparatus 30 by the pair of paper discharge rollers 24.

The post-processing apparatus 30 performs post processing, such as punching, stapling, or center folding processing, on the sheet(s) S transported from the image forming apparatus main body 10. As shown in FIG. 1, the post-processing apparatus 30 is connected to the image forming apparatus main body 10 for use. It should be noted that the post-processing apparatus 30 is not limited to the one that performs the post processing on the sheet(s) S transported from the image forming apparatus main body 10. The post-processing apparatus may be one that performs the post processing on the sheet(s) S set on a tray (not shown) by a user, after transporting, by itself, the sheet(s) S to the position where it can perform the post processing.

Figure 3:
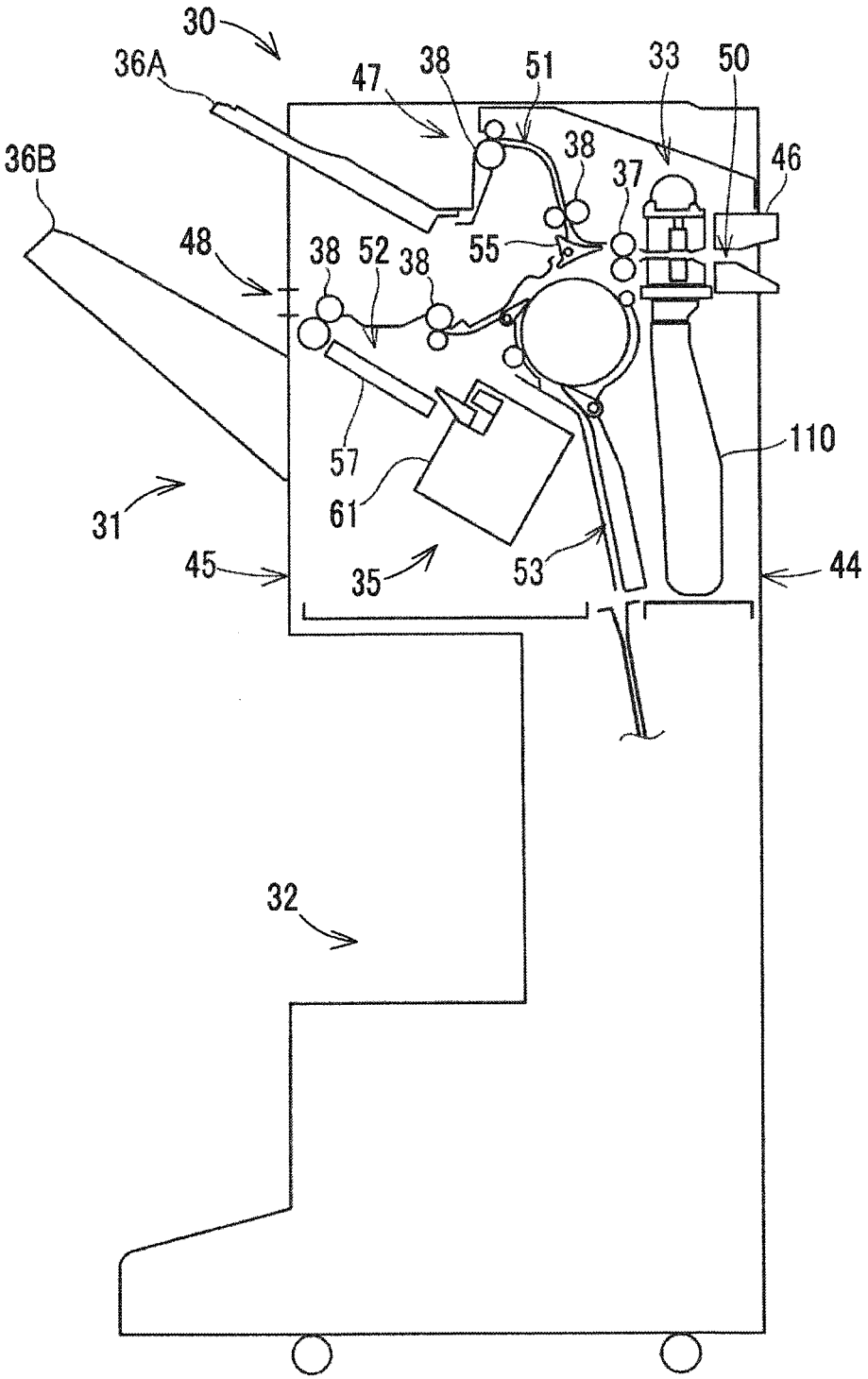
FIG. 3 is a cross-sectional view showing the configuration of a post-processing apparatus of the image forming apparatus according to the embodiment of the present disclosure.

As shown in FIG. 3, the post-processing apparatus 30 includes an upper main body 31 constituting an upper portion of the post-processing apparatus 30 and a lower main body 32 constituting a lower portion thereof. The post-processing apparatus 30 is centrally controlled by the control unit 100 included in the image forming apparatus 1.

The upper main body 31 is disposed on top of the lower main body 32. The upper main body 31 primarily includes a punching device 33, a paper chip receptacle 110, a stapling device 35, a pair of paper transport rollers 37, a plurality of pairs of paper transport rollers 38, an upper tray 36A, and a lower tray 36B. These components are disposed inside a housing constituting a casing and an inner frame of the post-processing apparatus 30. Each pairs of the paper transport rollers 37, 38 is composed of a driving roller and a driven roller, and serves to transport a sheet S transported from the image forming apparatus main body 10. The punching device 33 carries out punching processing on the sheet S transported from the image forming apparatus main body 10. The stapling device 35 carries out stapling processing on the sheets S. The upper tray 36A and the lower tray 36B hold the sheets S discharged from the post-processing apparatus 30.

The upper main body 31 has, on a connecting surface 44 (right-side surface in FIG. 3) connected with the image forming apparatus main body 10, a carry-in port 46 for receiving a sheet S with an image formed thereon, from the image forming apparatus main body 10. The upper main body 31 also has, on its upper surface, a discharge port 47 for discharging a sheet S to the outside of the post-processing apparatus 30. The upper tray 36A is arranged corresponding to the discharge port 47. Further, the upper main body 31 has, on its side surface 45 (left-side surface in FIG. 3), another discharge port 48 for discharging a sheet S to the outside of the post-processing apparatus 30. The lower tray 36B is arranged corresponding to the discharge port 48.

Inside the upper main body 31, a transport path 50 is formed to extend horizontally from the carry-in port 46. The pair of paper transport rollers 37, composed of a driving roller and a driven roller, is arranged at an end of the transport path 50 on the downstream side in the sheet transport direction.

The punching device 33 performs punching processing on the sheet S transported on the transport path 50. When the sheet S reaches a prescribed position on the transport path 50, a hole is formed at an end of the sheet S by the punching device 33. A detailed configuration of the punching device 33 will be described later.

Figure 4:
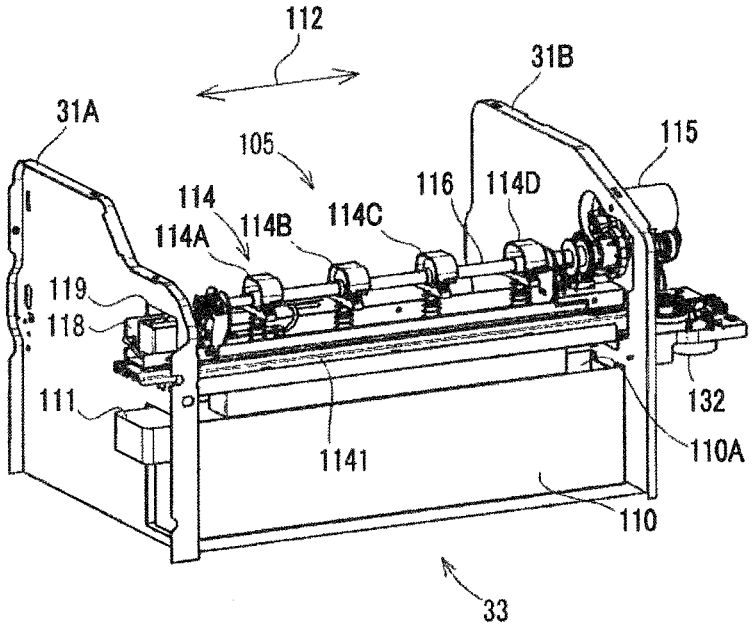
FIG. 4 shows the configuration of a punching device included in the post-processing apparatus shown in FIG. 3.

As shown in FIG. 4, the paper chip receptacle 110 is disposed beneath the punching device 33. The paper chip receptacle 110, which is for collecting and storing paper chips generated in the punching processing by the punching device 33, is in a thin rectangular parallelepiped shape. The paper chip receptacle 110 is configured to be detachable from the upper main body 31. A user can hold a handle 111 (see FIG. 4) attached to the paper chip receptacle 110 and pull it to detach the paper chip receptacle 110 from the upper main body 31. An opening 110A (see FIG. 4) is formed on an upper surface of the paper chip receptacle 110, and the above-described paper chips generated by the punching device 33 are received by the paper chip receptacle 110 through the opening 110A.

As shown in FIG. 3, the stapling device 35 is disposed downstream of the punching device 33 in the transport direction of sheets S, in the vicinity of a transport path 52, which will be described later. The stapling device 35 includes a stack tray 57 and a stapling unit 61.

The stack tray 57 constitutes a lower-side guide surface of the transport path 52. The sheets S fed onto the transport path 52 are sequentially guided to the stack tray 57 and held by the stack tray 57. In other words, the stack tray 57 is for holding the sheets S fed onto the transport path 52. The stapling unit 61 performs stapling processing on the sheets S held in the stack tray 57. The sheets S that have been stapled are discharged to the lower tray 36B by the pair of paper transport rollers 38.

The transport path of sheets S branches from the terminal end of the transport path 50 into two paths: a transport path 51 which extends toward the upper surface of the upper main body 31; and the transport path 52 which extends toward the side surface 45 of the upper main body 31. The transport path 51 leads to the discharge port 47, and the transport path 52 leads to the discharge port 48 via the stapling device 35. The transport path of sheets S further branches from the transport path 52 to a transport path 53 which extends downward toward the lower main body 32. The transport path 53 leads to a center folding device (not shown) included in the lower main body 32. The transport paths 50 to 53 are each formed with two guide plates arranged to face each other to form a gap through which a sheet S can be transported.

At each branch point of the transport paths 50 to 53, a flap 55 is provided which is pivotally moved by a driving unit such as a motor or a solenoid. The sheet S is transported to a predetermined destination as the flap 55 is pivotally moved to an appropriate position.

The lower main body 32 is disposed beneath the upper main body 31. The lower main body 32 primarily includes the center folding device for folding a sheet S. A description of the configuration of the center folding device will be omitted.

As shown in FIG. 4, the punching device 33 includes a punching unit 105, a motor 115 for punching (hereinafter, referred to as "punching motor 115"), and a motor 132 for driving the punching unit (hereinafter, referred to as "unit driving motor 132"). The punching device 33 is formed to have its longer sides extending in an orthogonal direction 112 which is orthogonal to the transport direction of the sheet S transported on the transport path 50, and in parallel with the surface of the sheet S transported on that path. In the upper main body 31, longitudinal frames 31A and 31B are provided, spaced apart from each other in the orthogonal direction 112, to face each other. The punching device 33 has its both ends in the orthogonal direction 112 supported by the longitudinal frames 31A and 31B. The longitudinal frame 31A is disposed on the front surface side of the post-processing apparatus 30, and the longitudinal frame 31B is disposed on the rear surface side of the post-processing apparatus 30.

The punching unit 105 performs punching processing on the sheet S that is passing through the transport path 50. As shown in FIG. 4, the punching unit 105 includes a punching station 114, a shaft 116, and a support table 118. The punching station 114 has four punching blades 114A, 114B, 114C, and 114D arranged at uniform intervals in the orthogonal direction 112, and a flat-plate common die 1141 disposed beneath the punching blades 114A, 114B, 114C, and 114D. The common die 1141 has holes formed in the positions corresponding to the punching blades 114A, 114B, 114C, and 114D. The punching blades 114A, 114B, 114C, and 114D and the shaft 116 are held above the support table 118, and the common die 1141 is held beneath the support table 118. The support table 118 and the common die 1141 are connected to each other with a prescribed spacing therebetween in the up-and-down direction. The gap between the punching blades 114A, 114B, 114C, and 114D and the common die 1141 forms a part of the transport path 50. Therefore, when a sheet S transported on the transport path 50 reaches the punching device 33, the leading edge in the transport direction of the sheet S enters the gap, and the sheet S is further transported to the downstream side in the transport direction of the sheet S.

In the state where a sheet S is positioned in the gap between the punching blades 114A, 114B, 114C, and 114D and the common die 1141, one or more of the punching blades 114A, 114B, 114C, and 114D are driven downward, whereby one or more holes are formed in the sheet S. Each punching blade 114A, 114B, 114C, 114D is driven downward using the driving force of the punching motor 115. In the present embodiment, the punching blades 114A and 114D on the respective sides in the orthogonal direction 112 perform the downward punching operations synchronously, and the punching blades 114B and 114C at the center in the orthogonal direction 112 perform the downward punching operations synchronously. In other words, the pair of punching blades 114A and 114D and the pair of punching blades 114B and 114C perform the downward punching operations independently from each other. Alternatively, it may be configured such that each punching blade 114A, 114B, 114C, 114D can perform the punching operation independently from each other.

The punching unit 105 is supported by the inner frame of the upper main body 31 in such a way as to be slidable in the orthogonal direction 112. For such a slide support mechanism of the punching unit 105, for example in the case where the common die 1141 of the punching unit 105 is supported by the lower side edges of openings 119 formed in the longitudinal frames 31A and 31B as shown in FIG. 4, a rail support mechanism is applicable. More specifically, the rail support mechanism includes a projecting guide which is provided at the lower side edge of each opening 119, and a rail groove which is provided on the rear surface of the common die 1141 to extend in the orthogonal direction 112. The common die 1141 is supported in the state where the guides are inserted into the rail groove, so that the common die 1141 can slide in the orthogonal direction 112. The slide support mechanism of the punching unit 105 is not limited to such a rail support mechanism; any mechanism is adoptable as long as it can support the punching unit 105 in such a way as to be movable in the orthogonal direction 112. The punching unit 105 is thus movable in the orthogonal direction 112.

The punching unit 105 is configured to be movable in the orthogonal direction 112 by the driving force of the unit driving motor 132. The unit driving motor 132 is a DC motor such as a stepping motor. The unit driving motor 132 is an example of the driving unit that moves the punching unit 105 in the orthogonal direction which is orthogonal to the transport direction.

Figure 5:
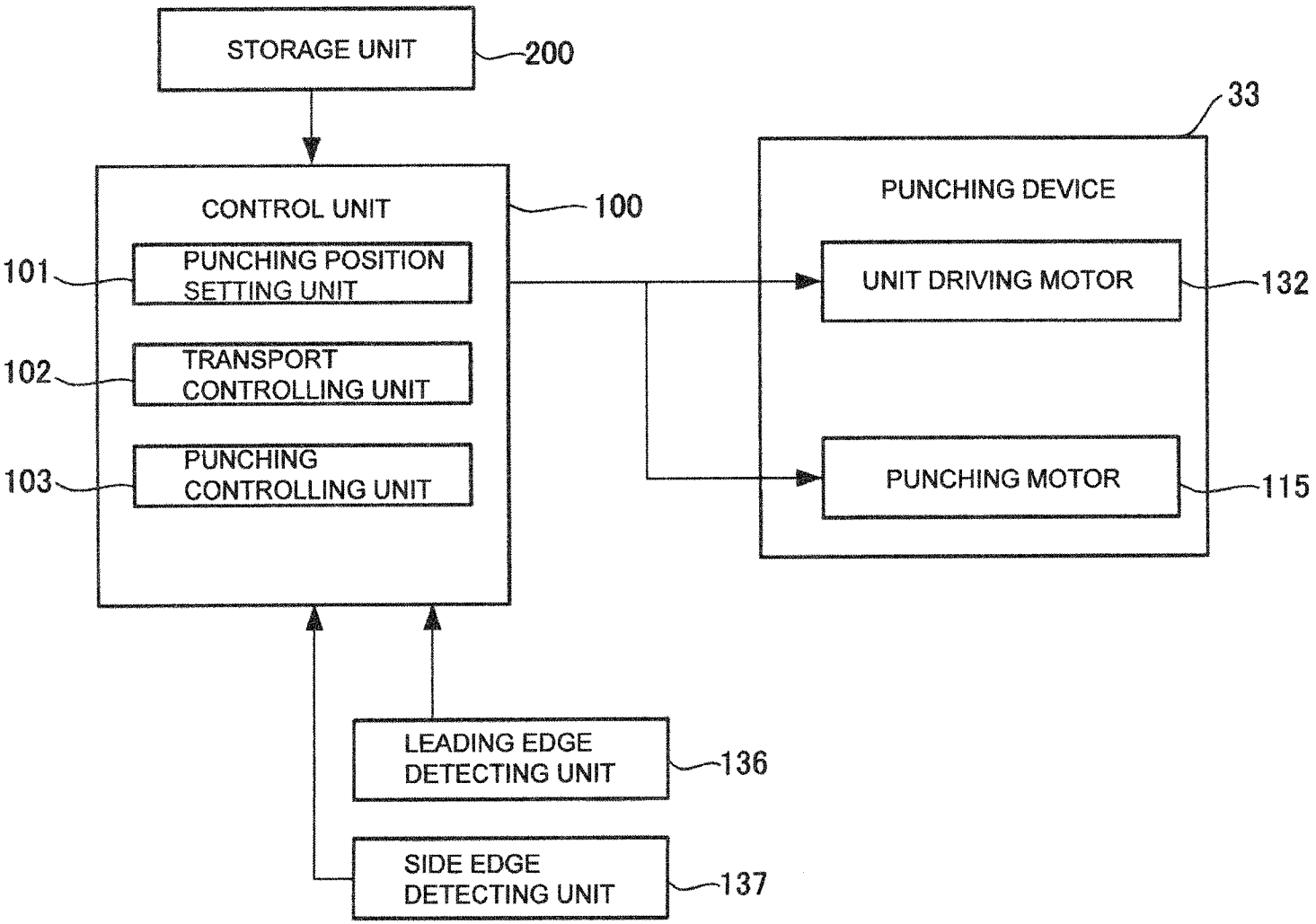
FIG. 5 is a block diagram showing a control system of the post-processing apparatus shown in FIG. 3.

As shown in FIG. 5, the image forming apparatus 1 has the control unit 100. The control unit 100 includes a CPU (not shown), a ROM (not shown), and a RAM (not shown). The CPU is a processor which performs various kinds of arithmetic processing. The ROM is a non-volatile storage unit which stores, in advance, information such as a control program for causing the CPU to perform various kinds of processing. The RAM is a volatile storage unit which is used as a primary storage memory (work area) when the CPU performs various kinds of processing. The control unit 100 controls the operations of the image forming apparatus 1 as the CPU executes the program stored in the ROM.

The control unit 100 is electrically connected with a storage unit 200, the unit driving motor 132, the punching motor 115, a leading edge detecting unit 136, and a side edge detecting unit 137.

The storage unit 200 is a storage unit such as a hard disk drive (HDD). In the image forming apparatus 1, a plurality of punching patterns are provided by the punching device 33. That is, the number of holes and the positions for forming the holes are predetermined for example for each sheet S size, and in accordance with long-side or short-side binding. Here, the long-side binding refers to the punching pattern according to which a plurality of holes are formed along the long side, while the short-side binding refers to the punching pattern according to which a plurality of holes are formed along the short side. Examples of the punching patterns are shown in FIGS. 6A, 6B, and 6C.

Figure 6A:
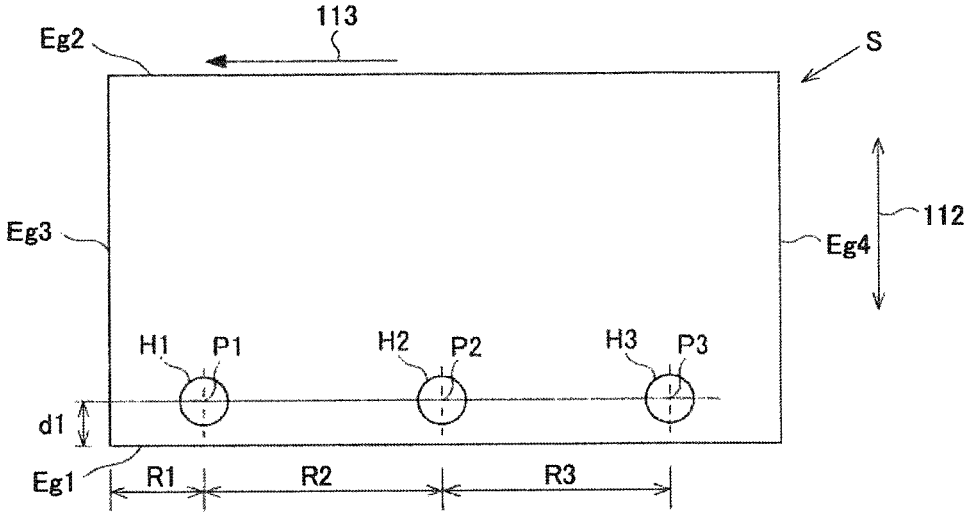
FIGS. 6A to 6C show examples of punching patterns.

The punching pattern shown in FIG. 6A is a pattern according to which three holes H1, H2, and H3 are punched out in a sheet S transported in the state where its long-side direction is in parallel with the sheet transport direction 113, the holes being formed along one side of the sheet S. With this punching pattern, the three holes H1, H2, and H3 are each punched out at a position a prescribed distance d1 away from one edge Eg1 of the edges Eg1 and Eg2 in the orthogonal direction 112 of the sheet S. Further, with this punching pattern, the hole H1 is punched out such that the center P1 of the hole H1 is at a position a distance R1 away from the leading edge Eg3 of the sheet S in its transport direction 113, the second hole H2 is punched out such that the center P2 of the hole H2 is at a position a distance "R1+R2" away from the leading edge Eg3 of the sheet S in its transport direction 113, and the third hole H3 is punched out such that the center P3 of the hole H3 is at a position a distance "R1+R2+R3" away from the leading edge Eg3 of the sheet S in its transport direction 113. The hole H1 is the first hole H1 firstly formed in the sheet S, the hole H2 is the second hole H2 secondly formed in the sheet S, and the hole H3 is the third hole H3 lastly (thirdly) formed in the sheet S.

Figure 6B:
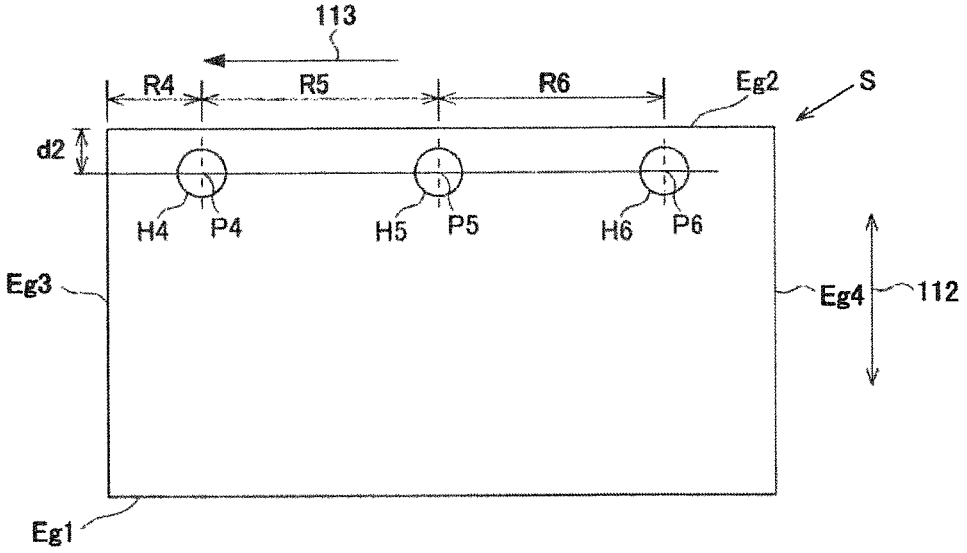

The punching pattern shown in FIG. 6B is a pattern according to which three holes H4, H5, and H6 are punched out in a sheet S transported in the state where its long-side direction is in parallel with the sheet transport direction 113, the holes being formed along the side opposite to the side on which the holes are formed in the punching pattern shown in FIG. 6A. With this punching pattern, the three holes H4, H5, and H6 are each punched out at a position a prescribed distance d2 away from one edge Eg2 of the edges Eg1 and Eg2 in the orthogonal direction 112 of the sheet S. The distance d2 may be the same as the distance d1. Further, with this punching pattern, the hole H4 is punched out such that the center P4 of the hole H4 is at a position a distance R4 away from the leading edge Eg3 of the sheet S in its transport direction 113, the hole H5 is punched out such that the center P5 of the hole H5 is at a position a distance "R4+R5" away from the leading edge Eg3 of the sheet S in its transport direction 113, and the hole H6 is punched out such that the center P6 of the hole H6 is at a position a distance "R4+R5+R6" away from the leading edge Eg3 of the sheet S in its transport direction 113. In this manner, the punching unit 105 is capable of punching at least three holes in the transported sheet S sequentially along its transport direction 113.

Figure 6C:
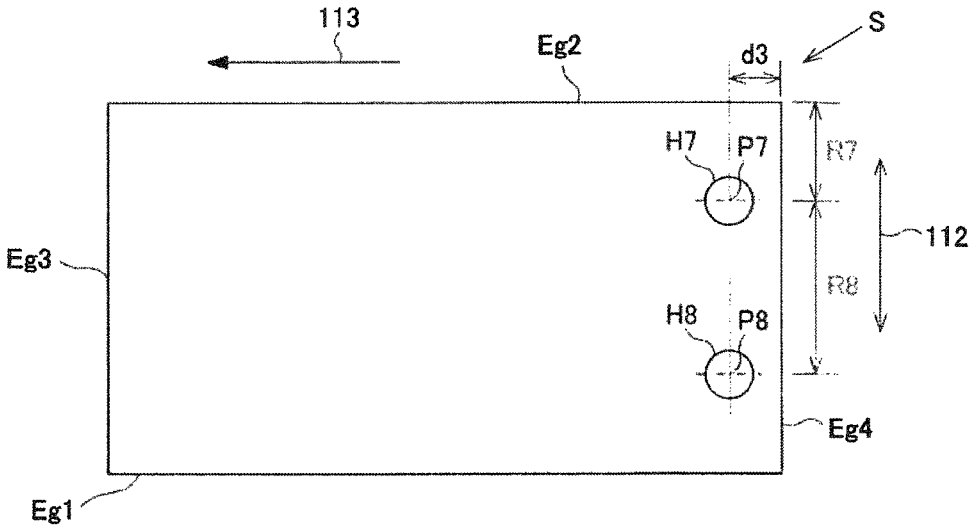

The punching pattern shown in FIG. 6C is a pattern according to which two holes H7 and H8 are punched out along the tail end of a sheet S which is transported in the state where its long-side direction is in parallel with the transport direction 113 of the sheet S. With this punching pattern, the two holes H7 and H8 are each punched out at a position a prescribed distance d3 away from the tailing edge Eg4 of the sheet S in its transport direction 113. Further, with this punching pattern, the hole 7 is punched out such that the center P7 of the hole H7 is at a position a distance R7 away from the edge Eg2 of the sheet S in the orthogonal direction 112, and the hole H8 is punched out such that the center P8 of the hole H8 is at a position a distance "R7+R8" away from the edge Eg2 of the sheet S in the orthogonal direction 112. The storage unit 200 stores, in advance, the information about the number of holes and the positions for forming the holes indicating the punching patterns as described above.

Figure 7A:
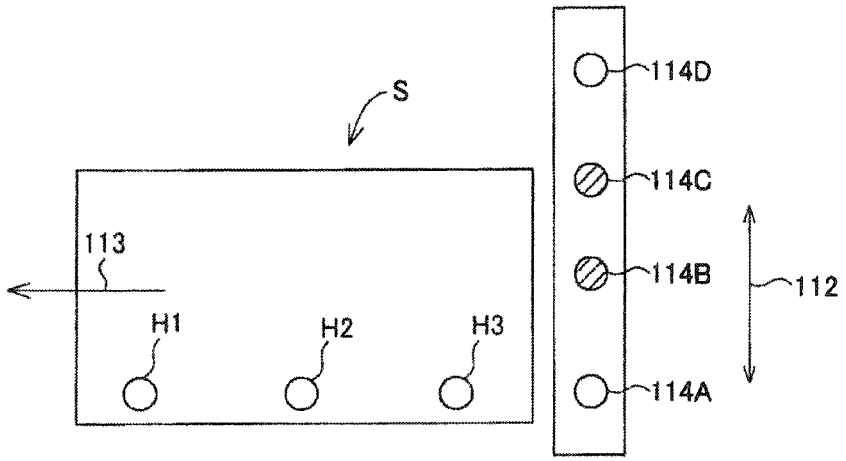
FIGS. 7A to 7C illustrate punching blades used in accordance with the punching patterns.
Figure 7B:
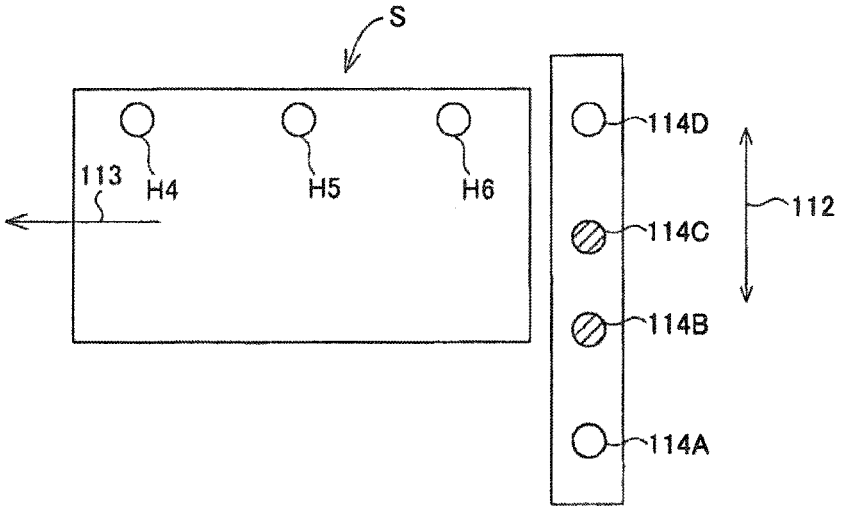
Figure 7C:
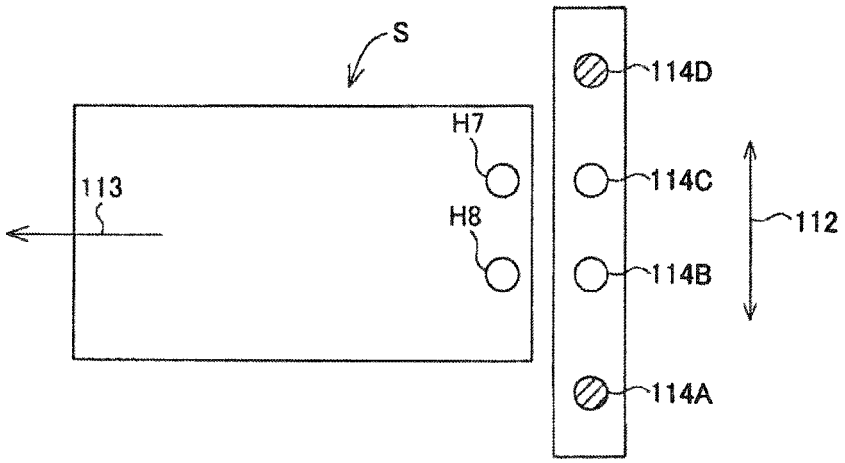

In the present embodiment, the two punching blades 114A and 114D at the respective ends in the orthogonal direction 112 perform downward punching operations synchronously, and the punching blades 114B and 114C at the center in the orthogonal direction 112 perform downward punching operations synchronously, as described above. In the case where the punching unit 105 performs the punching processing in accordance with the punching pattern shown in FIG. 6A, the punching blades 114A and 114D are used, as shown in FIG. 7A. At this time, the punching blade 114A forms the holes H1 to H3, while the punching blade 114D performs so-called idle punching. In the case where the punching unit 105 performs the punching processing in accordance with the punching pattern shown in FIG. 6B, the punching blades 114A and 114D are used, as shown in FIG. 7B. At this time, the punching blade 114D forms the holes H4 to H6, while the punching blade 114A performs idle punching. In the case where the punching unit 105 performs the punching processing in accordance with the punching pattern shown in FIG. 6C, the punching blades 114B and 114C are used, as shown in FIG. 7C.

Returning to FIG. 5, the leading edge detecting unit 136 is arranged on the transport path 50. The leading edge detecting unit 136 is for detecting the position of the leading edge in the transport direction 113 of the sheet S transported on the transport path 50. The leading edge detecting unit 136 is, for example, a transmissive or reflective photosensor.

Figure 8:
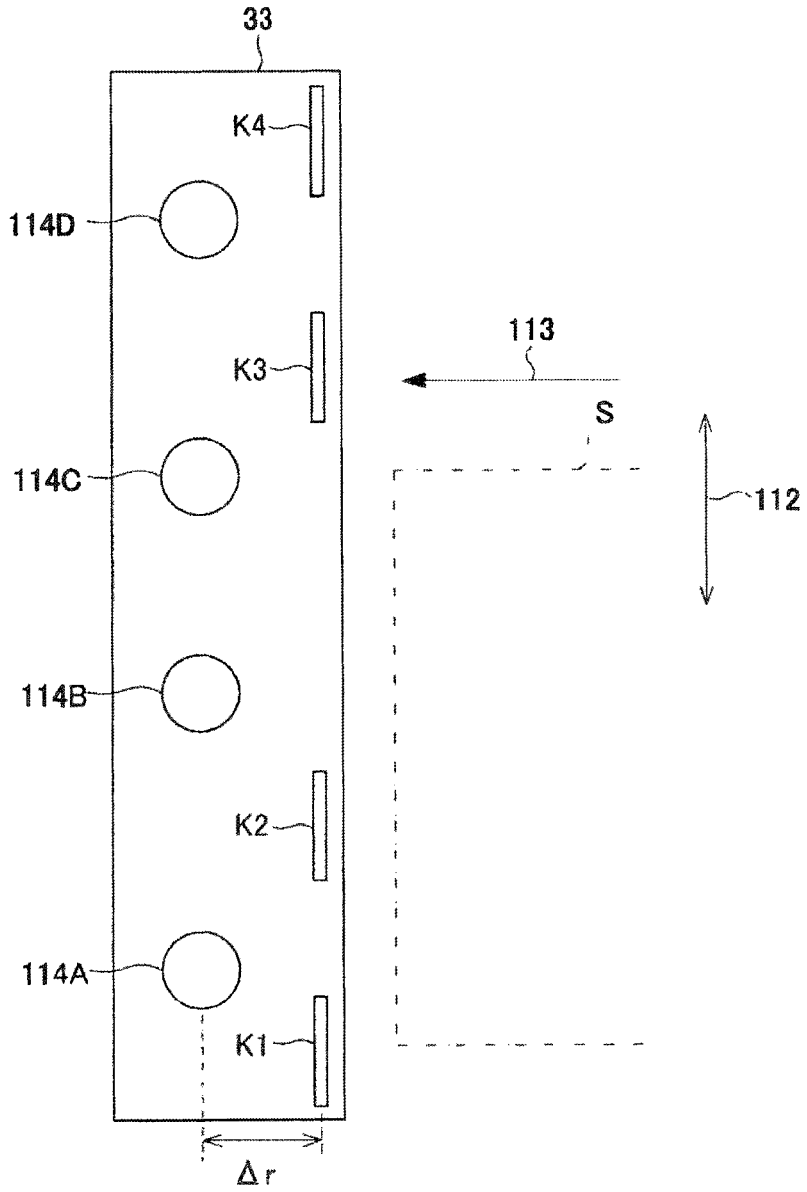
FIG. 8 illustrates a positional relationship between the punching blades and detection sensors which detect a side edge of a sheet.

The side edge detecting unit 137 is for detecting the edge position of one of the both sides of the sheet S with respect to its transport direction 113. The side edge detecting unit 137 includes a plurality of detection sensors K1 to K4 disposed in the punching device 33, as shown in FIG. 8. Each of the detection sensors K1 to K4 is a reflective photosensor, for example. The detection sensors K1 to K4 are arranged side by side at positions a prescribed distance Δr away from the positions of the punching blades 114A, 114B, 114C, and 114D on the upstream side in the sheet transport direction 113. In the orthogonal direction 112, the detection sensors K1 to K4 are arranged in accordance with the sizes of the sheets S which may be transported. That is, it is configured such that the detection area of each of the detection sensors K1 to K4 corresponds to a part of the area through which one side edge of the sheet S of the corresponding size passes.

When there is an instruction from a user to perform punching processing on a sheet S, the control unit 100 stops transportation of the sheet S when the leading edge of the sheet S reaches the position where a hole is to be punched out by any of the punching blades 114A, 114B, 114C, and 114D, and causes the punching blades 114A and 114D, or 114B and 114C, corresponding to the punching pattern selected by the user, to perform the punching processing. After the punching processing is finished, the transportation of the sheet S is resumed, and the sheet S with the holes punched out is discharged to the upper tray 36A or the like.

Incidentally, as explained above, in the case of punching a plurality of holes along the long-side direction of a sheet S by the punching device 33 which is movable in the orthogonal direction 112, in order to correct the punching position in the orthogonal direction 112 for the punching device 33 to perform the punching processing in accordance with the inclined state of the sheet S, the position of one of the edges in the orthogonal direction 112 of the sheet S may be detected for each punching operation, so as to determine the punching position of the punching device 33 on the basis of the detected edge position.

In this case, however, the time required for producing a printed matter may increase by the time required for the detecting operation.

Thus, in the present embodiment, to solve the above-described problem, the control unit 100 executes a program using the CPU to implement a punching position setting unit 101, a transport controlling unit 102, and a punching controlling unit 103, as shown in FIG. 5. In the following description, it is assumed that the punching pattern shown in FIG. 6A has been selected by a user.

Figure 9:
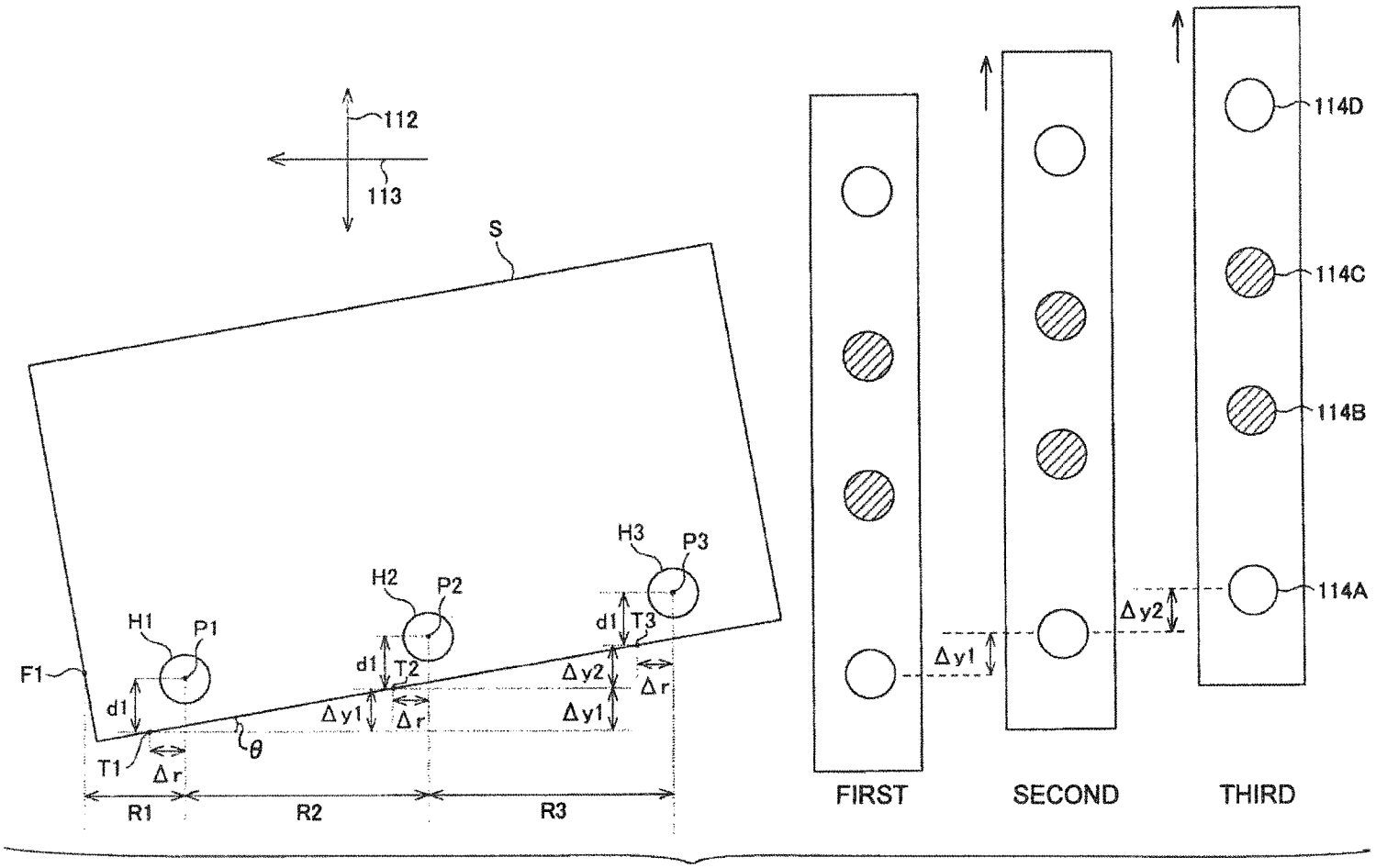
FIG. 9 illustrates how a punching unit is moved in the direction orthogonal to the sheet transport direction in accordance with the inclined state of a sheet.

FIG. 9 shows how the punching unit 105 is moved with respect to the sheet S that has been transported in an inclined state. When the punching position setting unit 101 receives from the leading edge detecting unit 136 a leading edge detection signal indicating that the leading edge F1 (see FIG. 9) of the transported sheet S has been detected, the punching position setting unit 101 causes one of the detection sensors included in the side edge detecting unit 137 that corresponds to the size of the sheet S to start the detecting operation. Here, it is assumed that the detection sensor K1 shown in FIG. 8 starts the detecting operation. When the sheet S is transported by a distance "R1−Δr" from the reception of the leading edge detection signal, the punching position setting unit 101 acquires a detection signal from the detection sensor K1.

When the punching position setting unit 101 receives the detection signal from the detection sensor K1, the punching position setting unit 101 detects a position of the side edge of the sheet S (hereinafter, this position will be referred to as "first edge position T1") on the basis of the received detection signal. This first edge position T1 is a position in the orthogonal direction 112 with reference to a predetermined position as an origin. In the present embodiment, the first hole H1 is formed at a position a predetermined distance d1 in the orthogonal direction 112 away from the first edge position T1 toward the opposite sheet edge side. In other words, the first edge position T1 is a reference position in the orthogonal direction 112 for determining the position where the first hole H1 is to be formed.

When the sheet S is transported from the first edge position T1 by the distance R2 after the first hole H1 was formed, the punching position setting unit 101 acquires a detection signal from the detection sensor K1 and, on the basis of the acquired signal, detects a position of the side edge of the sheet S (hereinafter, this position will be referred to as "second edge position T2"). Likewise the first hole H1, the second hole H2 is formed at a position the distance d1 in the orthogonal direction 112 away from the second edge position T2 toward the center of the sheet S. The second edge position T2 is a reference position in the orthogonal direction 112 for calculating the position where the second hole H2 is to be formed. The side edge detecting unit 137 corresponds to the edge detecting unit that detects, in at least two locations separated from each other in the transport direction 113, an edge position of an edge of the sheet S on one side in the orthogonal direction 112.

When the sheet S is inclined, the first edge position T1 and the second edge position T2 differ from each other. The punching position setting unit 101 calculates the amount of change Δy1=(T2−T1) in the orthogonal direction 112 between the first edge position T1 and the second edge position T2. An inclined angle θ of the sheet S with respect to the sheet transport direction is expressed by the following expression, by using the separation distance R2 between the first hole H1 and the second hole H2 in the sheet transport direction 113.

$$\theta=\tan^{-1}\{(T2-T1)/R2\}=\tan^{-1}(\Delta y1/R2) \quad (1)$$

It should be noted that the separation distance R2 is a known value which is predetermined in accordance with the punching pattern, as explained above. In the present embodiment, the punching position setting unit 101 calculates the separation distance R2 by multiplying the transport speed of the sheet S by the time taken from when the first hole H1 was formed to when the movement of the punching unit 105 is stopped for forming the second hole H2. In the case where the transportation of the sheet S is also carried out by a stepping motor, the separation distance R2 can be calculated on the basis of the number of step pulses input to the stepping motor. In this case, the separation distance R2 may be calculated on the basis of the number of step pulses detected from when the first edge position T1 was detected to when the second edge position T2 is detected. In this manner, the inclined angle θ of the sheet S with respect to the sheet transport direction is calculated on the basis of the amount of change Δy1 between the two edge positions detected by the side edge detecting unit 137.

The punching position setting unit 101 sets the punching position in the orthogonal direction 112 of the punching unit 105 corresponding to the position of the third hole H3 which is to be formed in the sheet S along the transport direction of the sheet S.

Here, in the present embodiment, the punching unit 105 is not returned to a prescribed home position each time a hole H1, H2, or H3 is formed; instead, the punching unit 105 is moved directly from its previous punching position to a current punching position. Therefore, the punching position setting unit 101 of the present embodiment calculates, as a value representing the punching position in the orthogonal direction 112 of the punching unit 105 corresponding to the position of the third hole H3, the amount of movement Δy2 in the orthogonal direction 112 from the previous punching position of the punching unit 105, i.e. the punching position in the orthogonal direction 112 of the punching unit 105 corresponding to the position of the second hole H2.

With regard to the amount of movement Δy2 by which the punching unit 105 should move so as to punch the third hole H3, the following expression (2) holds from FIG. 9.

$$\tan\theta=\Delta y1/R2=\Delta y2/R3 \quad (2)$$

From this expression (2) and the above expression (1), the amount of movement Δy2 is calculated from the following expression.

$$\Delta y2=(R3/R2)\times\Delta y1 \quad (3)$$

More specifically, the punching position setting unit 101 calculates the ratio (R3/R2) of the separation distance R3 between the second hole H2 and the third hole H3 in the sheet transport direction 113 to the separation distance R2 between the first hole H1 and the second hole H2 in the sheet transport direction 113. Further, the punching position setting unit 101 calculates, as the amount of movement Δy2 to the next punching position, the value (R3/R2)×(T2−T1) by multiplying the amount of change Δy1=(T2−T1) between the edge position T1 and the edge position T2 by the above ratio (R3/R2). It should be noted that the separation distance R3 is a known value which is predetermined in accordance with the punching pattern, as explained above. In the present embodiment, the punching position setting unit 101 calculates the separation distance R3 by multiplying the transport speed of the sheet S by the time taken from when the second hole H2 was formed to when the movement of the punching unit 105 is stopped for forming the third hole H3. As stated above, when the transportation of the sheet S is also performed by the stepping motor, the separation distance R3 can be calculated on the basis of the number of step pulses input to the stepping motor. In this case, the separation distance R3 may be calculated on the basis of the number of step pulses from when the second edge position T2 was detected to when the third edge position T3 is detected. In the case where the distance between the neighboring holes in the sheet transport direction is uniform, or, when R2=R3, then (R3/R2)=1, so the amount of movement Δy2 becomes Δy1. In this case, the punching unit 105 may be moved by the amount of change Δy1 from the current position toward the other side edge. In this manner, the punching position setting unit 101 obtains the amount of movement Δy2 from the punching position of the punching unit 105 for punching the second hole H2, as a value representing the punching position in the orthogonal direction 112 of the punching unit 105 for the third hole H3.

The transport controlling unit 102 controls the operations of a driving motor (not shown) which drives the pair of paper discharge rollers 24 and the pair of paper transport rollers 37. The transport controlling unit 102 controls the operations of the driving motor such that the sheet S is transported except for the time when the transportation of the sheet S is stopped as a hole is to be punched in the sheet S by the punching unit 105.

The punching controlling unit 103 controls the operations of the unit driving motor 132 and the punching motor 115 on the basis of each punching position set by the punching position setting unit 101. The punching controlling unit 103 causes the punching unit 105 to move to each punching position set by the punching position setting unit 101 and punch a hole in the sheet S.

Specifically, the punching controlling unit 103 first determines which one of the punching blades 114A, 114B, 114C, and 114D is to be used for punching. For example, the punching controlling unit 103 determines the punching blade to be used, such that the amount of movement of the punching unit 105 from its predetermined home position is the smallest. It is here assumed that the punching controlling unit 103 has determined to use the punching blade 114A for punching.

When the first edge position T1 is calculated by the punching position setting unit 101, the punching controlling unit 103 causes the unit driving motor 132 to move the punching unit 105 by the distance d1 in the orthogonal direction 112 from the first edge position T1. When the sheet S is transported by the distance R1 from when the detection signal indicating that the leading edge F1 of the transported sheet S has been detected was received from the leading edge detecting unit 136, the transport controlling unit 102 stops the transportation of the sheet S. As the transport speed of the sheet S is predetermined, the transport distance R1 of the sheet S is calculated based on the transport time. The punching controlling unit 103 then causes the punching blade 114A in the punching unit 105 to punch the first hole H1. In FIG. 9, there is a distance Δr in the sheet transport direction 113 between the first edge position T1 and the center position P1 of the first hole H1, because the sheet S is transported by the distance Δr during the time from when the first edge position T1 was detected by the punching position setting unit 101 to when the first hole H1 is formed. When the punching blade 114A in the punching unit 105 has finished punching the first hole H1, the transport controlling unit 102 resumes the transportation of the sheet S by the above-described driving motor.

Further, when the second edge position T2 is calculated by the punching position setting unit 101, the punching controlling unit 103 causes the unit driving motor 132 to move the punching unit 105 by the distance d1 in the orthogonal direction 112 from the second edge position T2. When the sheet S is transported by the distance "R1+R2" from when the detection signal indicating that the leading edge F1 of the transported sheet S has been detected was received from the leading edge detecting unit 136, the transport controlling unit 102 stops the transportation of the sheet S. The punching controlling unit 103 then causes the punching blade 114A in the punching unit 105 to punch the second hole H2. When the punching blade 114A in the punching unit 105 has finished punching the second hole H2, the transport controlling unit 102 resumes the transportation of the sheet S by the driving motor.

Further, when the amount of movement Δy2 by which the punching unit 105 should move so as to punch the third hole H3 is calculated by the punching position setting unit 101, the punching controlling unit 103 causes the unit driving motor 132 to move the punching unit 105 by the amount of movement Δy2 in the orthogonal direction 112. That is, the punching controlling unit 103 causes the punching unit 105 to move directly from the punching position of the second hole H2 to the punching position of the third hole H3. When the sheet S is transported by the distance R3 from when the second hole H2 was punched, the transport controlling unit 102 stops the transportation of the sheet S. The punching controlling unit 103 then causes the punching blade 114A in the punching unit 105 to punch the third hole H3. When the punching blade 114A in the punching unit 105 has finished punching the third hole H3, the transport controlling unit 102 resumes the transportation of the sheet S by the driving motor.

The punching processing controlled by the control unit 100 will now be described with reference to FIG. 10. The punching processing is carried out when there is a user instruction to perform punching processing together with printing processing on a sheet S. In the flowchart in FIG. 10, the reference characters S1, S2, and others denote step numbers. In the following description, it is assumed that the punching pattern shown in FIG. 6A has been selected by a user.

Figure 10:
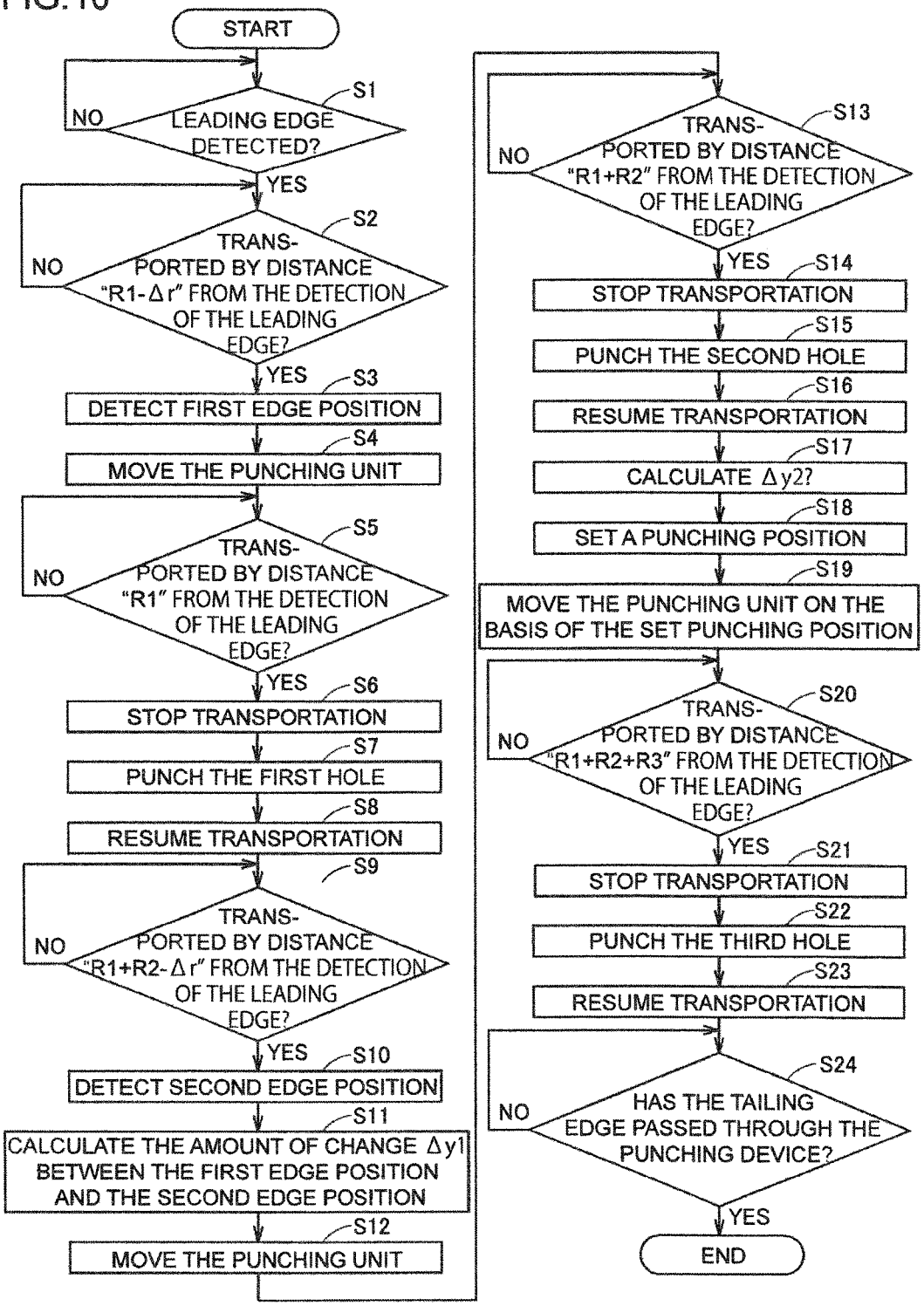
FIG. 10 is a flowchart illustrating punching processing controlled by a control unit.

As shown in FIG. 10, when a leading edge detection signal indicating that the leading edge F1 of the transported sheet S has been detected is received from the leading edge detecting unit 136 (YES in step S1), the punching position setting unit 101 determines whether the sheet S has been transported by the distance "R1−Δr" from when the leading edge detection signal was received (step S2).

If the punching position setting unit 101 determines that the sheet S has not been transported by the distance "R1−Δr" from the reception of the leading edge detection signal (NO in step S2), the unit enters standby mode. Once the punching position setting unit 101 determines that the sheet S has been transported by that distance (YES in step S2), the punching position setting unit 101 acquires a detection signal from the detection sensor K1 corresponding to the size of the sheet S, and detects the first edge position T1 of the sheet S on the basis of the detection signal received from the detection sensor K1 (step S3). The punching controlling unit 103 causes the unit driving motor 132 to move the punching unit 105 in the orthogonal direction 112 to a position that is the distance d1 away from the first edge position T1 toward the opposite edge side (step S4).

The transport controlling unit 102 determines whether the sheet S has been transported by the distance R1 from the reception of the leading edge detection signal (step S5). If the transport controlling unit 102 determines that the sheet S has not been transported by the distance R1 (NO in step S5), the unit enters standby mode. Once the transport controlling unit 102 determines that the sheet S has been transported by the distance R1 (YES in step S5), the transport controlling unit 102 stops the transportation of the sheet S (step S6). The punching controlling unit 103 causes the punching blade 114A in the punching unit 105 to punch the first hole H1 (step S7). Thereafter, the transport controlling unit 102 resumes the transportation of the sheet S (step S8).

The transport controlling unit 102 determines whether the sheet S has been transported by the distance "R1+R2−Δr" from the reception of the leading edge detection signal (step S9). If the transport controlling unit 102 determines that the sheet S has not been transported by the distance "R1+R2−Δr" (NO in step S9), the unit enters standby mode. Once the transport controlling unit 102 determines that the sheet S has been transported by that distance (YES in step S9), the transport controlling unit 102 acquires a detection signal of the detection sensor K1, and detects the second edge position T2 of the sheet S on the basis of the detection signal received from the detection sensor K1 (step S10). The punching position setting unit 101 calculates the amount of change Δy1 in the orthogonal direction 112 between the first edge position T1 detected in step S3 and the second edge position T2 detected in step S10 (step S11). The punching controlling unit 103 causes the unit driving motor 132 to move the punching unit 105, in the orthogonal direction 112 to a position that is the prescribed distance d1 away from the second edge position T2 toward the opposite edge side (step S12).

The transport controlling unit 102 determines whether the sheet S has been transported by the distance "R1+R2" from the reception of the leading edge detection signal (step S13). If the transport controlling unit 102 determines that the sheet S has not been transported by the distance "R1+R2" (NO in step S13), the unit enters standby mode. Once the transport controlling unit 102 determines that the sheet S has been transported by the distance "R1+R2" (YES in step S13), the transport controlling unit 102 stops the transportation of the sheet S (step S14). The punching controlling unit 103 then causes the punching blade 114A in the punching unit 105 to punch the second hole H2 (step S15). Thereafter, the transport controlling unit 102 resumes the transportation of the sheet S (step S16).

Next, the punching position setting unit 101 calculates an amount of change Δy2 by using the amount of change Δy1 calculated in step S11 and the above-described expression (3) (step S17). The punching position setting unit 101 uses the amount of change Δy2 calculated by the punching position setting unit 101 to set the punching position in the orthogonal direction 112 of the punching unit 105 corresponding to the third hole H3 which is to be punched thirdly in the sheet S (step S18). The punching controlling unit 103 then causes the unit driving motor 132 to move the punching unit 105 located at the position where the second hole H2 was punched, to the punching position set in step S18 (step S19).

The transport controlling unit 102 determines whether the sheet S has been transported by the distance "R1+R2+R3" from the reception of the leading edge detection signal (step S20). If the transport controlling unit 102 determines that the sheet S has not been transported by the distance "R1+R2+R3" (NO in step S20), the unit enters standby mode. Once the transport controlling unit 102 determines that the sheet S has been transported by the distance "R1+R2+R3" (YES in step S20), the transport controlling unit 102 stops the transportation of the sheet S (step S21). The punching controlling unit 103 then causes the punching blade 114A in the punching unit 105 to punch the third hole H3 (step S22). Thereafter, the transport controlling unit 102 resumes the transportation of the sheet S (step S23). When the tail end of the sheet S has passed through the punching device 33 (step S24), a series of punching process steps on the sheet S is finished.

As described above, in the present embodiment, at the time of punching the third hole H3, the position of the side edge of the sheet S is not detected; instead, the punching position of the punching unit 105 at the time of punching the third hole H3 is estimated by using the amount of change Δy1 between the first edge position T1 and the second edge position T2. Thus not detecting with the detection sensor the position of the side edge of the sheet S at the time of punching the third hole H3 can improve the production efficiency of a printed matter, compared to the case of detecting the position of the side edge. It is also possible to punch a hole in an appropriate position in the sheet S transported to the punching device 33.

While the preferred embodiment of the present disclosure has been described above, the present disclosure is not limited to the content described above; various modifications are applicable.

In the embodiment described above, the amount of change between the first edge position T1 and the second edge position T2 is calculated while the holes are punched.

The present disclosure however is not limited thereto. In the case where the detection sensor for detecting the side edge is arranged separately from the punching device 33 on its upstream side, it may be configured such that the first edge position T1 and the second edge position T2 are detected by the detection sensor and the amount of change therebetween is calculated before the holes are punched.

In the above embodiment, the position of the side edge of the sheet S is detected at the time point when the sheet S has been transported by the distance "R1−Δr" from when the leading edge of the sheet S was detected and also detected at the time point when the sheet S has been transported by the distance "R1+R2−Δr", and the amount of change between the detected first and second edge positions T1 and T2 is calculated. The present disclosure however is not limited thereto. For example, the detection sensor corresponding to the size of the transported sheet S may be caused to perform the detecting operation for a prescribed period of time, and the inclined state (inclined angle) of the sheet S may be determined in accordance with the changes of the detection signals of the detection sensor with respect to the distances by which the sheet S is transported during the prescribed period of time.

In the above embodiment, the punching unit 105 is not returned to a prescribed home position each time the hole H1, H2, or H3 is punched; instead, the punching unit 105 is moved directly from its previous punching position to a current punching position. The present disclosure however is not limited thereto; it also encompasses the case where the punching unit 105 is returned to a prescribed home position each time the hole H1, H2, or H3 is punched.

In the embodiment described above, the case where the post-processing apparatus 30 is connected to the image forming apparatus main body 10 was given by way of example. The present disclosure is also applicable to the case where the post-processing apparatus 30 is formed integrally inside the image forming apparatus main body 10.

In the above embodiment, three holes were punched along the transport direction 113 of the sheet S. Alternatively, four or more holes may be punched in a similar manner. More specifically, the fourth hole and so on can each be regarded as the third hole in the above embodiment. This makes it possible to punch the hole in an appropriate position without detecting the edge position.

What is claimed is:

1. A punching device comprising:

a punching unit configured to punch at least three holes in a transported sheet sequentially along a transport direction of the sheet;

a driving unit configured to move the punching unit in an orthogonal direction which is orthogonal to the transport direction;

an edge detecting unit configured to detect, in at least two locations separated from each other in the transport direction, an edge position of an edge of the sheet on one side edge in the orthogonal direction;

a punching position setting unit configured to set a punching position corresponding to a hole to be punched by the punching unit in the orthogonal direction, on the basis of an amount of change in the orthogonal direction between the at least two edge positions detected by the edge detecting unit; and a punching controlling unit configured to cause the punching unit to move to the punching position set by the punching position setting unit and punch a hole in the sheet, wherein the edge detecting unit detects a first edge position corresponding to a first hole which is punched first in the sheet and a second edge position corresponding to a second hole which is punched downstream of the first hole in the transport direction, the punching position setting unit sets the punching position corresponding to a third hole which is punched by the punching unit downstream of the second hole in the transport direction in the orthogonal direction, on the basis of an amount of change between the first edge position and the second edge position detected by the edge detecting unit, the punching controlling unit causes the punching unit to move in the orthogonal direction on the basis of the first edge position and punch the first hole, move in the orthogonal direction on the basis of the second edge position and punch the second hole, and move to the punching position corresponding to the third hole set by the punching position setting unit and punch the third hole, and the punching position setting unit calculates a first separation distance in the sheet transport direction between the first hole and the second hole and a second separation distance in the sheet transport direction between the second hole and the third hole, calculates a position that is separated in the orthogonal direction from the punching position corresponding to the second hole by an amount of movement obtained by multiplying the amount of change between the first edge position and the second edge position by a ratio of the second separation distance to the first separation distance, and sets the calculated position as the punching position of the punching unit for the third hole.

2. The punching device according to claim 1, wherein when the punching position for the third hole is set by the punching position setting unit, the punching controlling unit causes the punching unit to move by the amount of movement from the punching position corresponding to the second hole to the punching position for the third hole.

3. An image forming apparatus comprising the punching device according to claim 1.

* * * * *